United States Patent [19]

Nattrass

[11] Patent Number: 4,597,102

[45] Date of Patent: Jun. 24, 1986

[54] INTERMEDIATE BULK CONTAINER

[75] Inventor: Frank Nattrass, Harrogate, England

[73] Assignee: Nattrass-Hickey & Sons, Ltd., Wetherby, England

[21] Appl. No.: 746,553

[22] Filed: Jun. 19, 1985

[30] Foreign Application Priority Data

Jun. 20, 1984 [GB] United Kingdom ..... 8415777
Jul. 18, 1984 [GB] United Kingdom ..... 8418328
Feb. 12, 1985 [GB] United Kingdom ..... 8503558

[51] Int. Cl.[4] ..... B65D 33/08; B65D 88/16; B65D 90/04

[52] U.S. Cl. ..... 383/105; 383/107; 383/113; 383/117; 220/470; 222/105

[58] Field of Search ..... 383/105, 107–109, 383/113, 117, 41; 220/470; 222/105, 185

[56] References Cited

U.S. PATENT DOCUMENTS 3,190,441 6/1965 Rausing ..... 383/109 X
3,291,375 12/1966 Lepisto ..... 383/113 X
3,789,897 2/1974 Saito ..... 383/109 X
3,870,358 3/1975 Bennett ..... 383/13 X
3,961,655 6/1976 Nattrass et al. ..... 383/109 X
4,124,136 11/1978 Bjelland et al. ..... 222/105 X
4,194,652 3/1980 Williamson et al. ..... 383/41 X

FOREIGN PATENT DOCUMENTS 62964 10/1982 European Pat. Off. ..... 220/470
463115 7/1928 Fed. Rep. of Germany ..... 383/108
2328764 1/1975 Fed. Rep. of Germany ..... 220/470

*Primary Examiner*—William Price
*Assistant Examiner*—Sue A. Weaver
*Attorney, Agent, or Firm*—Henry Sternberg; Bert J. Lewen

[57] ABSTRACT

An intermediate bulk container comprises an outer envelope (1 to 6) formed of flexible woven material and having seams (11 to 14). An impervious liner (20) of flexible material is contained within the outer envelope. The liner has tab means (27) lying outside the volume defined within the liner and secured, for example by stitching into a respective seam of the outer envelope. By appropriate location of the tab means on the liner the liner may be securely located within the outer envelope and prevented from distortion relative to the outer envelope.

17 Claims, 9 Drawing Figures

INTERMEDIATE BULK CONTAINER

This invention relates to intermediate bulk containers, that is to say large sacks or bags generally maufactured of flexible material and capable of holding one tonne or more of powdered or granular materials.

Such containers are generally manufactured from woven fabric, generally polypropylene. One long-standing problem in the industry has been to make such containers completely waterproof, problems being experienced particularly in the seam areas where water can permeate not only between the joined areas of fabric, but also through the stitching holes.

In view of this problem it has been common practice in the industry to utilise an impervious inner liner within the outer envelope of such containers, the product being transported actually being contained within the inner line. Liners previously used have generally been in the form of a cylindrical length of polyethylene or other impermeable plastics material. In the filling region of the container one end of the liner may be brought through a filling opening in the outer envelope and may be tied off after the container has been filled. At the discharge end of the container the liner is closed off and may be either laid loosely within the outer envelope or disposed in a predetermined relationship to an outlet spout from the outer envelope.

The liner constructions are loosely fitted within the outer envelope and are prone to distortion within the envelope, so inhibiting proper filling and/or discharge of the contents of the container.

The invention seeks to provide a container that avoids the disadvantages previously experienced with liners, yet can still be completely waterproof.

According to the invention an intermediate bulk container comprises an outer envelope formed of flexible woven material having a seam structure, and an impervious inner liner of flexible material within the outer envelope, the liner having tab means lying outside the volume defined within the liner and secured into the seam structure of the outer envelope to locate the liner within the outer envelope.

It will be seen that by appropriate positioning of the tab means on the inner liner, and that by securing the tab means to the seam structure in suitable regions of the seam structure, the liner can be held securely in the required position relative to the outer envelope without unwanted distortion of the liner. Thus, filling and emptying of the container can be effected without uncontrolled movement of the liner affecting either operation. Use of tab means lying outside the volume defined within the liner ensures that the securing of the tab means into the seam structure can be carried out without piercing or otherwise destroying the integrity of the liner material, so maintaining the liner impervious. Accordingly, even though moisture may penetrate the outer envelope of the container it is prevented by the liner from reaching the contents of the container.

The particular form and relationship of the seam structure and the tab means will be designed to suit the particular outer envelope and liner that constitute the container. At least one seam of the seam structure may have a continuous tab secured thereto along substantially the full length of that seam, or may have tab means secured thereto at spaced points along the length of the seam. In the latter case the tab means may be a continuous tab secured to the seam at spaced intervals, or the tab means may comprises a plurality of spaced, individual tabs. In the context of any one container a combination of continuously secured tab means or tab means secured only at spaced points may be used.

For many containers the most convenient method of securing the tab means into the seam structure will by by sewing. However, the invention is not so limited, and alternatively tab means may be secured to the seam structure at least partially by rigid mechanical attachment, for example by clipping, stapling, rivetting or eyeletting, and/or at least partially by adhesive.

The layout of the seam structure and accordingly the location of the tabs on the inner liner will also vary in accordance with different shapes and constructions of container. In one preferred construction the seam structure includes at least one seam extending between the top and the bottom of the outer envelope, and the tab means includes at least one tab secured into said seam. A number of different types of containers are manufactured with an outer envelope of substantially rectangular cross-section, and the seam structure may then conveniently include four seams each extending between the top and the bottom of the outer envelope at corner regions thereof. The tab means may then include at least four tabs each extending between the top and bottom of the inner liner at respective corner regions thereof, each seam having a respective one of said tabs secured thereto.

Seams extending between the top and bottom of the outer envelope may be present whether or not the outer envelope is made up of separate panels of material stitched together to form the substantially rectangular cross-section. Thus, rather than use separate panels the outer envelopes of such containers may be constructed from circular woven fabric and the seams will then simply be formed by lines of stitching joining together two thicknesses of the fabric adjacent to a fold line.

As an alternative, or in addition to a seam or seams extending between the top and bottom of the outer envelope, the seam structure may include at least one top seam extending substantially parallel to a top wall of the outer envelope, and/or at least one bottom seam extending substantially parallel to a bottom wall of the outer envelope. In the two respective cases the tab means will include at least one top tab secured into the top seam and/or at least one bottom tab secured into the bottom seam. This arrangement may be of particular utility when the side walls of the outer envelope of the container are formed from a single length of tubular woven fabric into which separate top and bottom panels are secured by seams. Top and bottom tabs may then extend substantially around the whole periphery of the top and bottom of the liner to be secured into those seams, those being the only fastenings between the outer envelope and the inner liner.

The tab structure may include at least one tab that is integral with the inner liner and/or at least one tab formed separately from the inner liner and secured thereto. Any integral tab may conveniently be formed by folding part of the inner liner to form two confronting layers and joining the two layers together by continuous welds substantially parallel to the fold line, the tab being then defined by the area between the weld and the fold line. Such liners may be made by a continuous extrusion process followed by welding as required to give a strip of welded liner material, liners of the required length then being cut from the strip. The length of the cut liner may be greater than the height of the container so that ends of the liner can be brought through filling and discharge openings respectively at the top and bottom walls of the outer envelope. Alternatively, a liner can be fabricated so as to fit very closely within the outer envelope and thus be economic in the amount of material used in forming the liner.

The invention will be better understood from the following description of embodiments of containers in accordance therewith, given by way of example only, with reference to the accompanying drawings in which.

Figure 1:
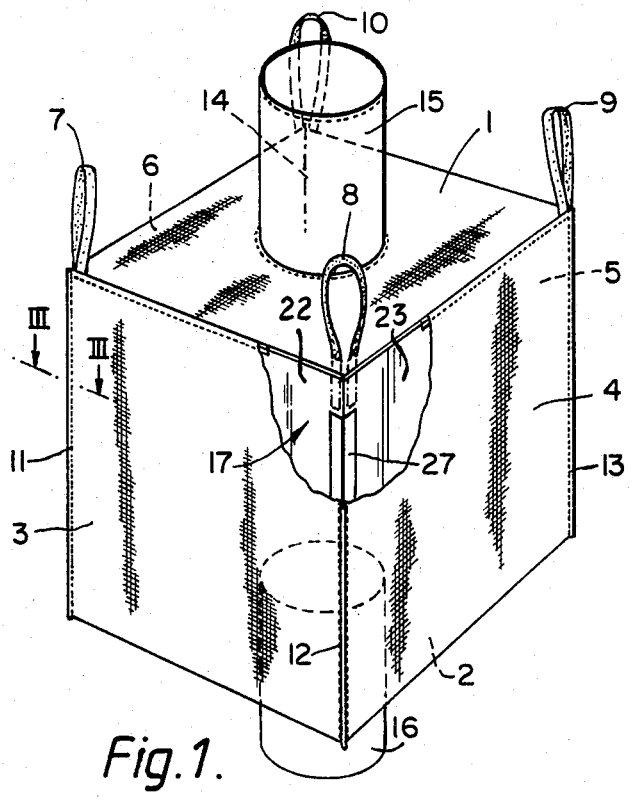
FIG. 1 is a schematic perspective view of an intermediate bulk container, with part cut away to show the internal structure.

FIG. 1 shows an intermediate bulk container having an outer envelope of generally square cross-section, with upper and lower walls 1 and 2, and four side walls 3 to 6. This outer envelope may be formed in any one of a number of different ways, but is generally formed by stitching together pieces of woven polypropylene fabric. The container has lifting loops 7 to 10 secured to the outer envelope at upper parts of each of four seams 11 to 14 that extend between the top and bottom of the container and join adjacent side walls. There are many other ways in which lifting loops may be provided at the upper part of a container, or in which the container may be constructed so that lifting may be effected by a band or hood extending over the top of the container and joined to two of the side walls. Such lifting arrangements are known and the invention is applicable to any container of this general type whatever lifting arrangement is used.

In the particular container shown in the drawings the top of the container is provided with an inlet spout 15 stitched to the top wall of the outer envelope around a hole cut in that wall. The container is also formed with a discharge spout 16 similarly stitched to the bottom wall of the outer envelope around a hole cut therein. Means are conventionally provided for closing and tying off the spouts as required.

Figure 3:
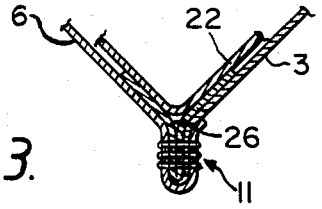
FIG. 3 is a cross-section on the line III—III of FIG. 1.

An impervious inner liner 17 is enclosed within the outer envelope of the container. As shown, the inner liner is produced from gussetted flexible polyethylene fabric folded into a shape having a substantially square cross-section and closely matching the inner dimensions of the outer envelope. It is not essential that the liner be produced from gussetted material and any simple box structure of impervious flexible material may be used. The liner has upper and lower walls 20 and 21 and side walls 22 to 25. A tab 26 to 29 is secured to the liner at each junction between adjacent side walls, the tabs lying outside the volume defined within the liner. Each tab is formed from plastics adhesive tape adhered to each of the intersecting walls and projecting significantly beyond the junction therebetween. In an alternative arrangement the tab could be a strip of plastics material, for example polyethylene, welded to the two intersecting liner walls. FIG. 3 shows the construction of seam 11, the construction of seams 12 to 14 is similar. The respective tab 26 extends into the seam 11 of the outer envelope, being sandwiched between fabric layers of the side walls 3 and 6 of the outer envelope and being secured thereto by the stitching of the seam 11. Thus, for most of the height of the inner liner it is positively secured in the required location by securing the tabs within the respective vertically extending seams of the outer structure.

Additionally, the liner includes inlet and discharge spouts 30 and 31 welded to the upper and lower walls of the liner around holes cut in those walls. The free end of each such spout is sewn or otherwise secured to the free end of the corresponding spouts 15, 16 of the outer envelope, and this has the effect of holding the upper and lower walls of the liner in the required positions relative to the upper and lower walls of the outer envelope.

In use, prior to filling, the stitched together discharge spouts of the liner and of the outer envelope are tucked into the bottom of the outer envelope in order to close off the base of the container. A filling tube is inserted into the inlet spout of the liner, and the material to be carried is loaded into the container. It will readily be seen that such filling is not impeded by the liner, since the liner is already held substantially to the oval shape of the outer envelope and can not be significantly distorted from that shape. After filling, the inlet spout of the inner liner is closed in any suitable manner, for example by folding to a flat configuration and welding the opposed surfaces of the inner liner together. The inlet spout of the outer envelope is also closed and the spouts folded to a swan-neck configuration lying on the top of the container. These closures, and the fact that the outer envelope is fully lined by the impervious liner ensures that the contents are fully protected from moisture. Moisture that may penetrate the stitching holes between the outer envelope and the tabs will remain outside the liner and not penetrate the volume defined therein. In order to discharge the contents the discharge spouts are simply released and opened.

Figure 4:
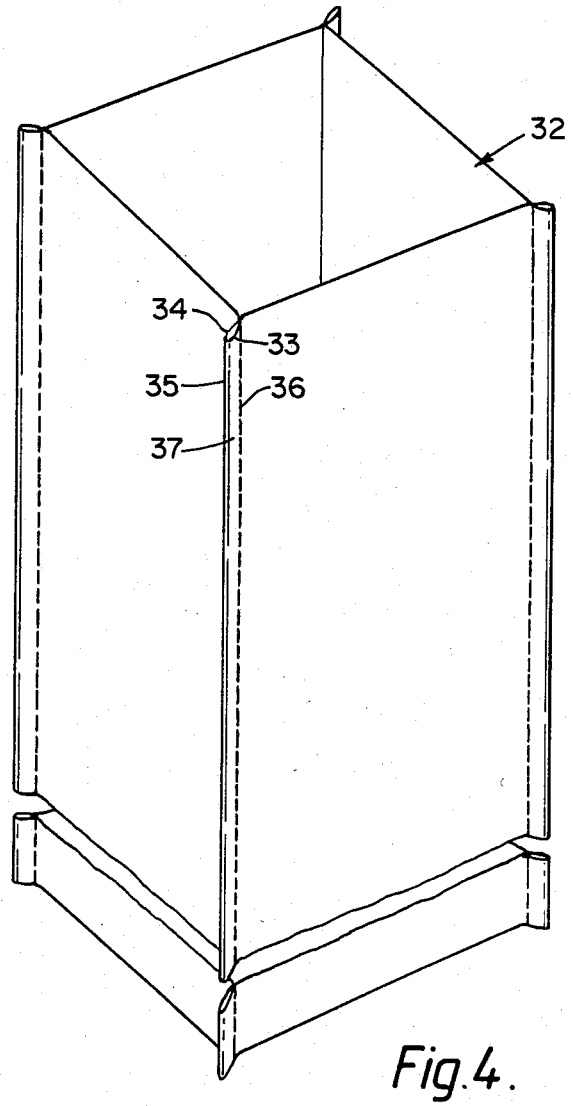
FIG. 4 shows a blank usable in the manufacture of alternative forms of liner.

FIG. 4 illustrates a continuous blank 32 from which alternative forms of inner liner may be formed. The blank is of a plastics material and may be formed by a continuous extrusion process. After extrusion four longitudinal welds are continuously effected along the length of the material so that the blank takes up the form shown in the Figure. It will be seen that in this form each of the four corner regions of the blank is constituted by a part of the inner liner folded to form two confronting layers 33, 34, joined by a fold line 35, the associated weld 36 extending substantially parallel to the fold line. A tab 37 extending the full length of the liner at that corner thereof is thus defined by the area between the weld 36 and the fold line 35, and lies outside the volume defined within the liner. There is a similar arrangement at each of the other corners of the blank. It will readily be seen that liners of any required length may be cut from the blank. Indeed, the blank may be perforated at regular intervals along its length so that liners may simply be torn, rather than cut, therefrom. In an alternative form the liner could be extruded in a substantially flat, folded and gussetted shape, four welds being effected in the corner regions as described. Again, such liner could be perforated at regular intervals and may also be transversely welded adjacent to each perforation so that each individual liner torn from the blank will have one open end and one closed end.

Figure 5:
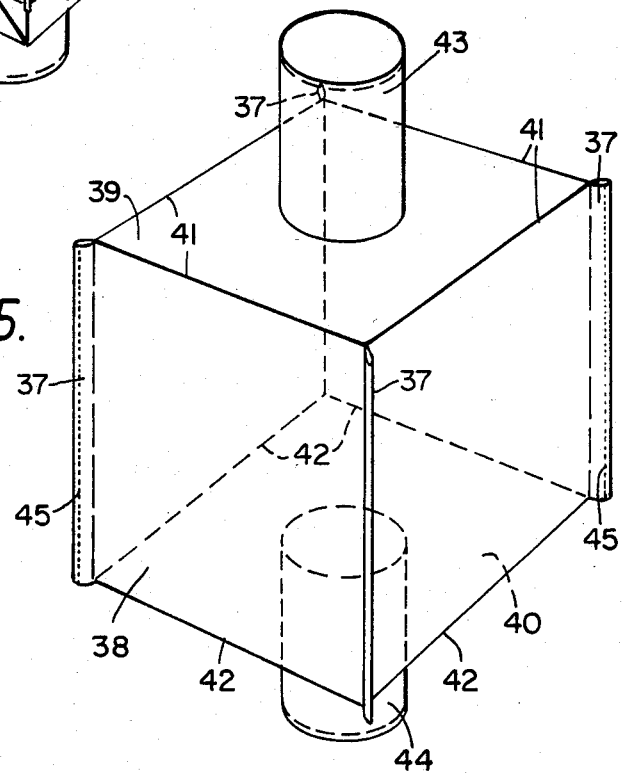
FIGS. 5 and 6 show alternative liners that may be made from the blank of FIG. 4.
Figure 7:
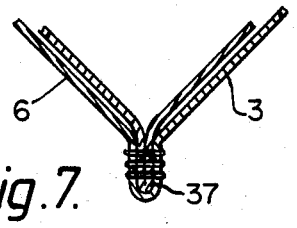
FIG. 7 is a section corresponding to FIG. 3, but using the liner of FIG. 5.

FIG. 5 shows one form of liner that may be made using the blank of FIG. 4. The body 38 of the liner is cut to the required length from the blank of FIG. 4, and the top and bottom walls 39 and 40 of impermeable plastics material are welded to the upper and lower edges of the body as at 41 and 42 respectively. A hole is cut in the centre region of each of the top and bottom walls 39, 40 and inlet and discharge spouts 43 and 44 are welded around those holes. The resulting structure is similar in shape to that illustrated in FIG. 2, but the tabs 37 are integral with the liner rather than separate pieces of material secured thereto. The liner shown in FIG. 5 may be secured into an outer envelope in a manner similar to that shown in FIG. 1, each tab 37 being stitched into a respective seam of the outer envelope by a line of stitching extending the full length of the tab and forming the seam stitching. Such stitching is indicated, for example, by the lines 45 in FIG. 5 and a cross-section of a typical seam construction is shown in FIG. 7.

Figure 6:
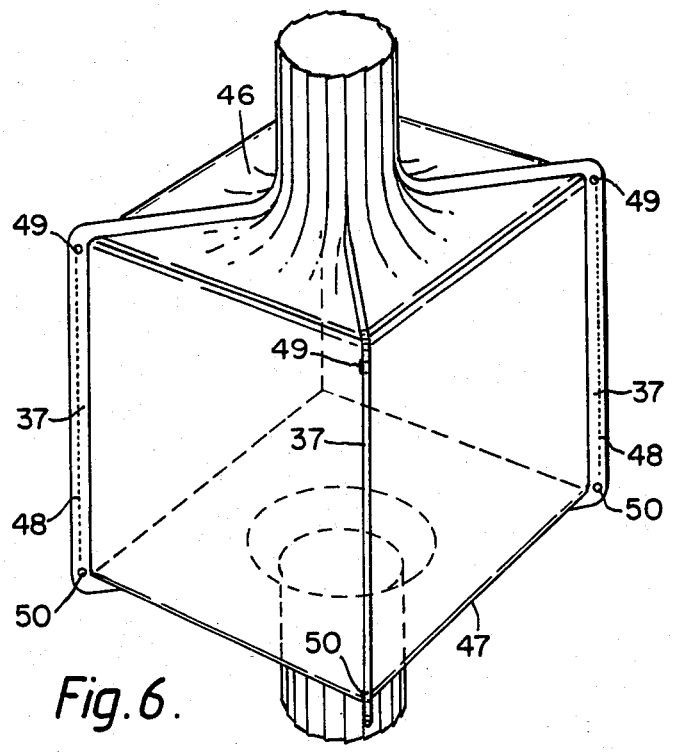

The blank of FIG. 4 may alternatively be used to form a liner such as illustrated in FIG. 6, which, in contrast to the FIG. 5 liner is not fully tailored to the shape of the outer envelope. Thus, the whole of the FIG. 6 liner is formed by a single length cut from the blank of FIG. 4, with ends of the blank folded inwardly and pleated or gathered together to form upper and lower sections 46,47 of the liner, each with a respective spout. The tabs 37 of the blank extend into the folded top and bottom regions, but do not perform any functions in those regions. The sections of the tabs that extend along the corners of the main body of the liner may, however, be used to secure the liner within the outer envelope, for example by lines of stitching 48 in a manner substantially identical to that described with reference to FIGS. 5 and 7. In each of the liner embodiments of FIGS. 2, 5 and 6 so far described, the liner has been secured by stitching the tabs into the seams of the outer envelope. However, stitching is not essential, and alternative securing methods are possible, for example tabs being secured within the seams by adhesive. In a further alternative, and illustrated in FIG. 6 although equally applicable to the embodiments of FIGS. 2 and 5, the tabs of the liner may be secured in the seams by rigid mechanical attachments at suitable points, for example points 49 and 50 in upper and lower regions of each tab. The mechanical attachment used may involve, for example, clipping, stapling, rivetting, or eyeletting, whichever method is best suited to the particular materials and container dimensions used.

Figure 8:
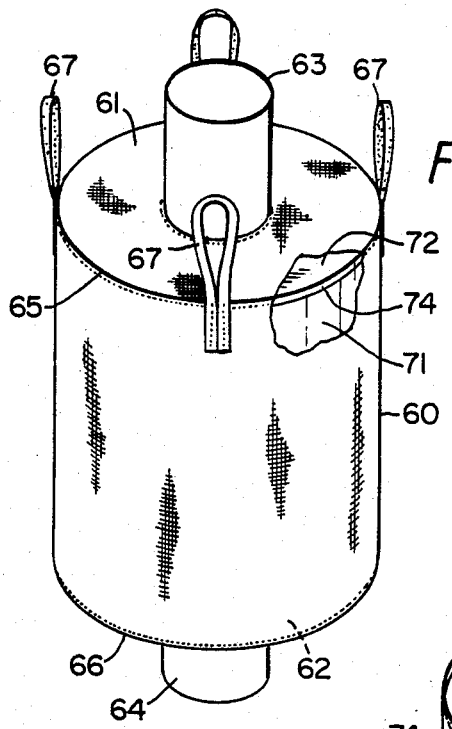
FIG. 8 is a view similar to FIG. 1 of an alternative embodiment of container.

FIG. 8 shows an intermediate bulk container having an outer envelope of generally circular cross-section. Such a container may conveniently have the outer envelope formed from a single length 60 of tubular woven fabric into which are stitched top and bottom walls 61, 62 having respective inlet and discharge spouts 63, 64, similar to those of FIG. 1. The top wall is joined to the body by a seam 65 lying substantially in the plane of the top wall, while the bottom wall is joined to the body by seam 66 lying substantially in the plane of the bottom wall. Lifting loops 67 may be secured as required to the outer envelope of the container.

Figure 9:
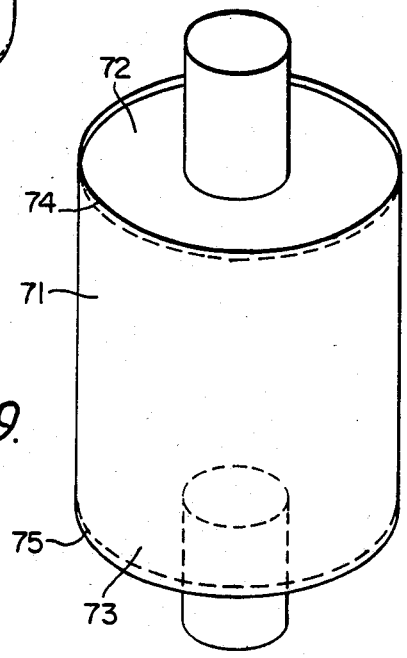
FIG. 9 shows a liner usable in the embodiment of FIG. 8.

FIG. 9 shows a liner for such container, the liner having a tubular body 71 closed by top and bottom walls, 72, 73 welded or otherwise secured to the body. Upper and lower tabs 74 and 75 are provided at the junction between the liner body and top and at the junction between the liner body and bottom. Each tab may be formed by an extension of either or both thicknesses of material between the weld joining them together, or may be of a separate piece of material adhered, welded or otherwise secured around the region of intersection. In each case the tab will project beyond the intersection sufficiently far for it to be stitched into the respective top or bottom seam of the outer envelope, in order that the liner is secured in position within the envelope.

The container of this form may be used in a manner similar to that of the FIG. 1 container, and will have similar advantages.

Figure 2:
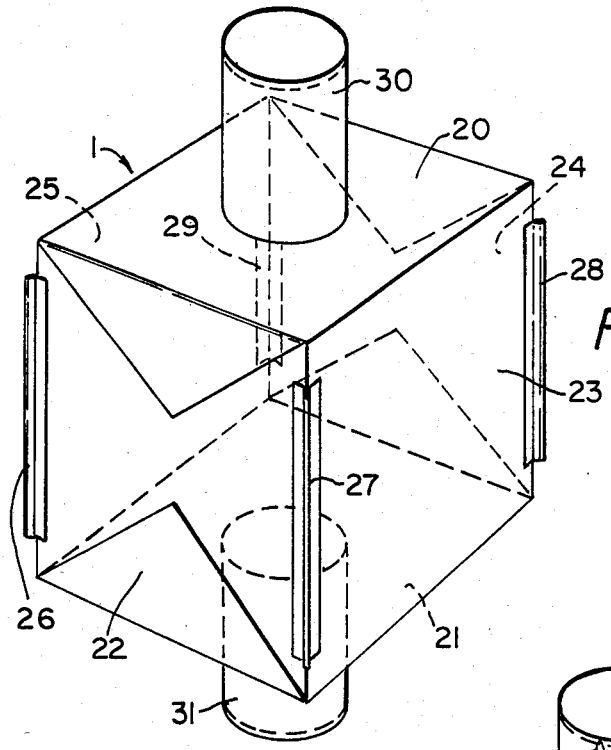
FIG. 2 is a perspective view of a liner used in the container of FIG. 1.

In modified forms the liners of FIGS. 2, 5 or 6 may each have upper and/or lower tabs similar to that of FIG. 9 in addition to the corner seam tabs. In all the embodiments shown the tab associated with any particular seam has been substantially co-extensive with that seam. However, it will be understood that any such continuous tab could be replaced by individual spaced tabs located as required on the liner.

Each of the containers described thus far have been provided with inlet and discharge spouts on both the outer envelope and the liner, but this is not essential. For example an inlet spout on the outer envelope may be omitted, with an inlet spout on the liner being brought through a simple opening cut in the top wall of the outer envelope. Alternatively, inlet spouts may be omitted from both the outer envelope and the inner liner, the container being both filled and emptied through a simple spout arrangement at the base of the container, with the container being inverted during filling. In a further alternative the discharge spout may be omitted from the inner liner, with or without a discharge spout present on the outer envelope. The container may then be emptied by merely cutting the inner liner, and if necessary the outer liner also.

In manufacturing a container according to the invention the liner is desirably pre-formed together with its spouts and tabs. The tabs can then be sewn into the seams of the outer envelope as this is stitched, little or no additional time being required in comparison with the manufacture of a conventional lined container. It will be seen that a completely waterproof container can result, and the problems with liner distortion during filling, transportation and emptying are avoided. It has also been found that the liner can be made from a significantly thinner gauge of plastics material than has been the case with conventional liners, so leading to further cost savings.

I claim:

1. An intermediate bulk container comprising an outer envelope formed of flexible woven material having a seam structure, and an impervious inner liner of flexible material within the outer envelope, the liner having tab means lying outside the volume defined within the liner and secured into the seam structure of the outer envelope to locate the liner within the outer envelope.

2. An intermediate bulk container according to claim 1 in which at least one seam of the seam structure has a continuous tab secured thereto along substantially the full length of that seam.

3. An intermediate bulk container according to claim 1 in which at least one seam of the seam structure has tab means secured thereto at spaced points along the length of that seam.

4. An intermediate bulk container according to claim 3 in which the tab means secured to said seam is a continuous tab.

5. An intermediate bulk container according to claim 1 in which the tab means is secured to the seam structure at least partially by sewing.

6. An intermediate bulk container according to claim 1 in which the tab means is secured to the seam structure at least partially by rigid mechanical attachment.

7. An intermediate bulk container according to claim 1 in which the tab means is secured to the seam structure at least partially by adhesive.

8. An intermediate bulk container according to claim 1 in which the seam structure includes at least one seam extending between the top and the bottom of the outer envelope, and the tab means includes at least one tab secured into said seam.

9. An intermediate bulk container according to claim 8 in which the outer envelope is of substantially rectangular cross-section, the seam structure includes four seams each extending between the top and the bottom of the outer envelope at corner regions thereof, and the tab means includes at least four tabs each extending between the top and bottom of the inner liner at a respective corner region thereof, each seam having a respective one of said tabs secured thereto.

10. An intermediate bulk container according to claim 9 in which each of said four seams has an associated continuous tab secured thereto by sewing along substantially the full length of the respective seam.

11. An intermediate bulk container according to claim 1 in which the seam structure includes at least one top seam extending substantially parallel to a top wall of the outer envelope, and the tab means includes at least one top tab secured into said top seams.

12. An intermediate bulk container according to claim 11 in which the top seam extends around substantially the whole periphery of the outer envelope and joins the top wall of the outer envelope to a side wall structure thereof and the top tab is substantially coextensive with the top seam.

13. An intermediate bulk container according to claim 1 in which the seam structure includes at least one bottom seam extending substantially parallel to a bottom wall of the outer envelope, and the tab means includes at least one bottom tab secured into said bottom seam.

14. An intermediate bulk container according to claim 13 in which the bottom seam extends around substantially the whole periphery of the outer envelope and joins the bottom wall of the outer envelope to a side wall structure thereof and the bottom tab is substantially coextensive with the bottom seam.

15. An intermediate bulk container according to claim 1 in which the tab structure includes at least one tab that is integral with the inner liner.

16. An intermediate bulk container according to claim 15 in which the inner liner is of plastics material and the tab structure includes at least one tab formed by folding part of the inner liner to form two confronting layers and joining the two layers together by a continuous weld substantially parallel to the fold line, the tab being then defined by the area between the weld and the fold line.

17. An intermediate bulk container according to claim 1 in which the tab structure includes at least one tab formed separately from the inner liner and secured to the inner liner.

* * * * *